United States Patent [19]

Levasseur

[11] Patent Number: 4,478,353

[45] Date of Patent: Oct. 23, 1984

[54] VENDOR CONTROL SYSTEM

[75] Inventor: Joseph L. Levasseur, St. Louis, Mo.

[73] Assignee: H. R. Electronics Company, St. Louis, Mo.

[21] Appl. No.: 352,938

[22] Filed: Feb. 26, 1982

[51] Int. Cl.[3] ..... G07F 5/22

[52] U.S. Cl. ..... 221/14; 194/1 N; 221/15

[58] Field of Search ..... 194/1 N, 1 M, 10; 221/13, 14, 15

[56] References Cited

U.S. PATENT DOCUMENTS

| | | | |
|---|---|---|---|
| 3,844,394 | 10/1974 | Hale et al. | 221/15 X |
| 3,848,718 | 11/1974 | Bookout | 194/10 X |
| 4,044,877 | 8/1977 | Burton | 194/10 |
| 4,234,070 | 11/1980 | Heiman | 194/10 X |

*Primary Examiner*—F. J. Bartuska

*Attorney, Agent, or Firm*—Haverstock, Garrett & Roberts

[57] ABSTRACT

A vend control system for vending machines which accept credit, have an established vend price, include customer actuatable selection capability, apparatus for producing a selected vend, and an empty product device operable to prevent energizing of the associated vend producing apparatus when the supply of articles to be vended thereby is exhausted, the improvement including a circuit for establishing a power connection when an amount deposited at least equals the established vend price, circuit elements constructed to respond to the power connection to establish a credit condition and to enable selecting a product for vending including generating a vend signal in response thereto, a circuit responsive to the generation of a vend signal to enable energizing of selected vend producing apparatus, and a switch device under control of each respective vend producing apparatus to establish a circuit condition in association with the respective empty product device to assure that an energized vend producing apparatus will remain energized for sufficient time to complete a vend cycle even if the product being vended is the last product capable of being vended by the selected vend producing apparatus, the circuit condition being established being established by a first bi-stable circuit device operable in conjunction with the switch device to maintain the energized vend producing apparatus in an energized condition, a second bi-stable circuit device under control of the first bi-stable circuit device to control the de-energizing of the vend producing apparatus and the termination of a vend cycle, and a reset circuit to reset the control system when a vend cycle is terminated.

14 Claims, 2 Drawing Figures

VENDOR CONTROL SYSTEM

Figure 1:
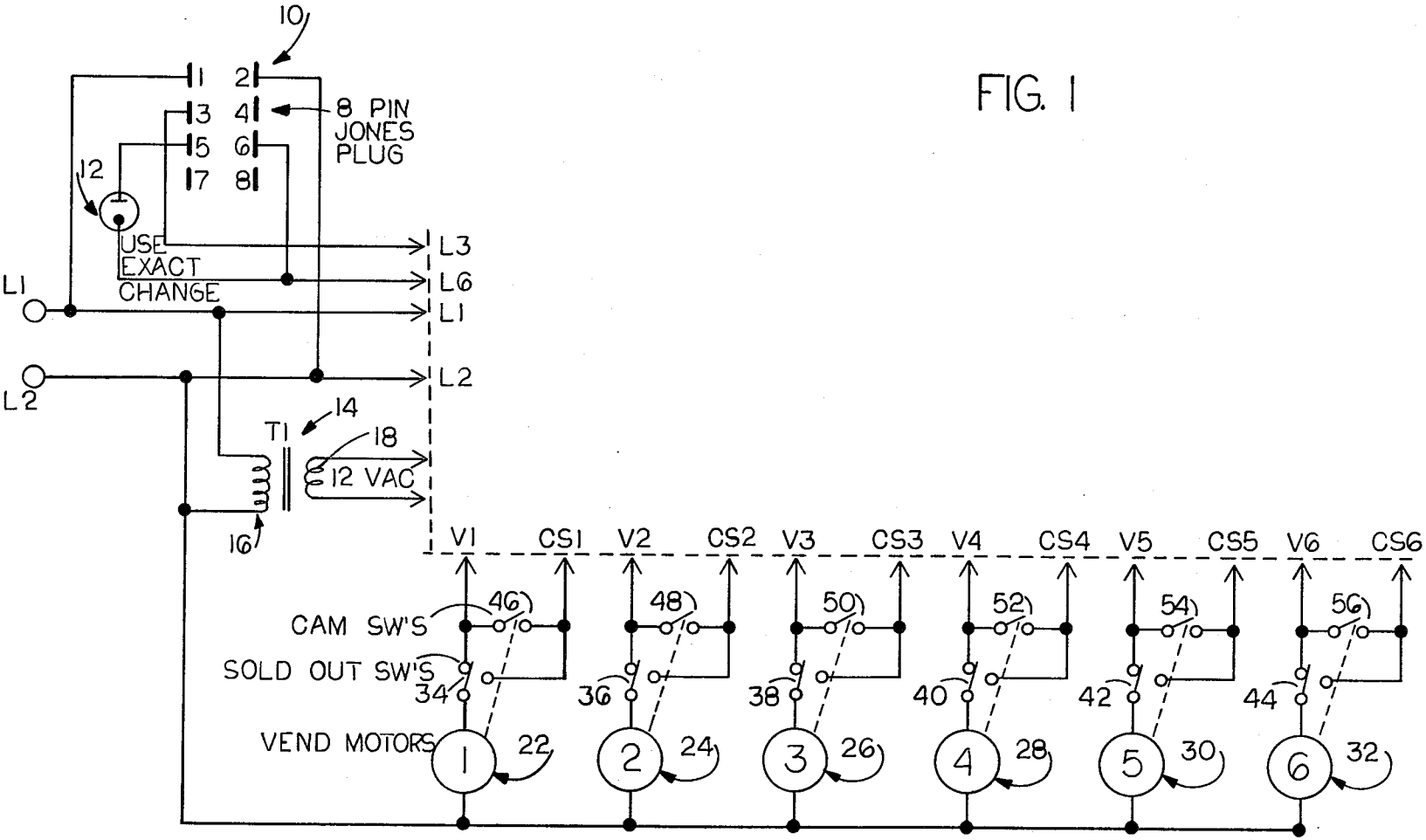

There are many vending control circuits in existence including control circuits which use integrated circuit elements and other solid state devices to control the accumulation of monies deposited, vend pricing information and control, product selection and control, the refunding of amounts deposited, and the paying back of excess deposits when a vend has been effected and the amount deposited exceeds the price of the selected vend. Typical of control circuits which have one or more of the above characteristics are the circuits disclosed in U.S. Pat. Nos. 3,307,671; 3,521,733; 3,508,636; 3,687,255; 3,820,642; 3,828,903; 3,841,456; 3,894,220; and 4,034,839, all assigned to Applicant's assignee. The present vendor control system employs some of the same principles and features employed in the known circuits but also includes additional structural and operational features which increase the usefulness and versatility of vending devices which employ the present circuit and provides capabilities not available with the known control circuits and systems.

One of the main improvements obtained with the present circuit occurs when a vend motor has been initiated to cause a vend operation to take place. When this happens the vend motor will drive a cam or like means to operate a cam switch such that if the product being vended is the last product available under control of that particular vend motor so that an empty product switch opens during the vending operation, this will not prevent the initiated vending cycle of operation from being completed and it will establish circuits which will prevent future effective energizing of the same vend motor until the supply of products to be vended thereby has been replenished. In other words, with the present circuit, once a vend operation has commenced the operable vend motor will be maintained energized to complete the cycle even if the product being vended should cause the sold out switch to transfer during vend indicating that that product is the last one that can be vended under control of the actuated selection switch and the associated vend motor. Operation of the associated sold out switch thereafter will not only indicate the unavailability of further vends of that product but will also provide a connection to maintain the vend motor operating until the last product that is available has been vended and the vend motor has made its full cycle of operation. No known vending control circuit or system accomplishes these things in the same way and using the same means as used in the present device. These are important features because not only do they establish conditions for advising the customer that future selections of a particular product are unavailable but they also give the customer the option of selecting other products that are available under control of other selection switches and other vend motors. This, therefore, enables and encourages maximum sales from a vending machine that has product selection from among a plurality of different products.

The present circuit also has other features and capabilities which are related to the features described above and these will be explained in detail hereinafter.

It is therefore a principal object of the present invention to provide an improved control circuit for vending machines and the like which include means to make sure that each time a vend motor is operated it will be operated for a full cycle even if the product being vended thereby is the last product available under control of a particular selection switch and vend motor.

Another object is to provide a relatively simple vend control circuit for a vending machine capable of vending a plurality of the same or of different products employing a plurality of different selection switches and vend motor means operable to vend products under control thereof.

Another object is to prevent a customer of a vending machine from losing money if he selects a product from a number of different products that is no longer available from the vending machine.

Another object is to provide an alternate circuit to maintain a vending motor energized to complete a vending cycle when the product being vended is the last product available for vending under control of that particular vend selection.

Another object is to employ an optical coupler device in the circuitry of a vending control system to maintain a vend motor operating for a full cycle of operation.

Another object is to provide a novel vend motor running and vend termination circuitry for a vend control circuit.

Another object is to provide novel vend time out circuitry for a vend control device.

Figure 2:
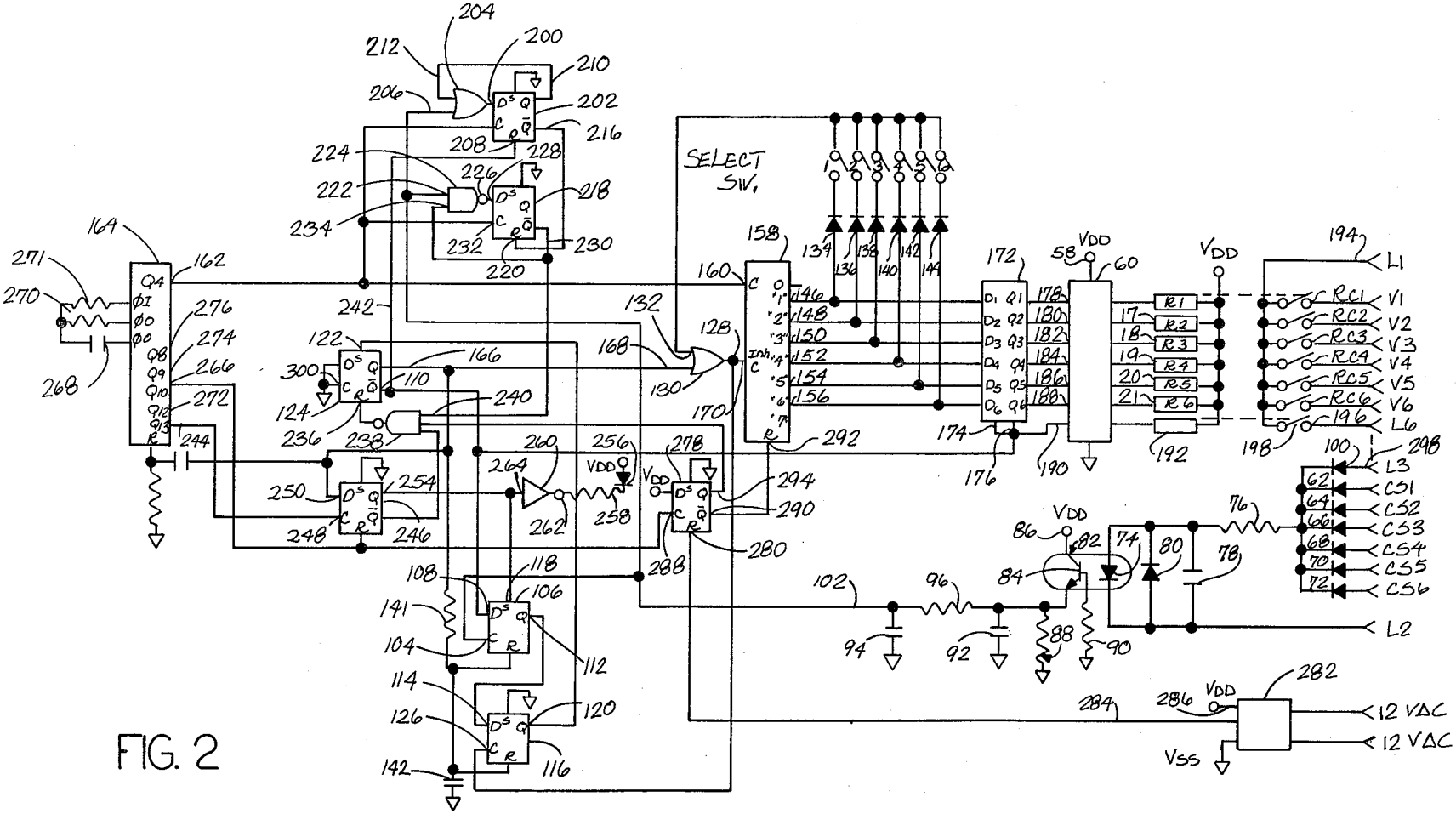

These and other objects and advantages of the present invention will become apparent after considering the following detailed specification in conjunction with the accompanying drawings, wherein:

FIG. 1 is a simplified circuit diagram for the vend motors and related switches, including the power connections therefor, for a vending control system constructed according to the present invention; and, FIG. 2 is a schematic circuit diagram showing more of the details of the circuitry for the subject vend control system. Referring to the drawings more particularly by reference numbers, and particularly to FIG. 1, the circuit shown therein includes an 8-pin plug 10 sometimes referred to as an 8-pin Jones plug, which is used to establish hard wire connections between the vend control circuitry of the present device and the operating elements under control thereof most of which are located in a vending machine. The Jones plug 10 has eight terminals numbered as shown with terminal 1 being connected to one side of a power source labeled L1 and terminal 2 being connected to the other side of the power source labeled L2. Terminal 3 is connected to another power lead labeled L3 which will be described later, terminal 5 is connected to and through an indicator light 12 to a lead labeled L6, and terminal 6 is also connected to lead L6. The circuit of FIG. 1 includes a power transformer 14, the primary 16 of which is connected across the leads L1 and L2. The transformer secondary 18, shown as producing a 12 volt output, is connected to the circuit of the present device and provides most of the operating voltage therefor.

In the lower portion of the circuit shown in FIG. 1 are connections to six vend motors 22–32, each of which has one of its terminals connected to the power lead L2. Any number of similarly connected vend motors could be included. The other terminals of the vend motors 22–32 are connected to respective sides of normally closed sold out switches 34–44, and the opposite sides of these switches are connected to respective leads $V_1$–$V_6$ which are power leads.

The leads $V_1$–$V_6$ are connected respectively to one side of normally open cam switches 46 14 56 which have their opposite sides connected to respective terminals CS1 14 CS6. Operation of the cam switches 46–56 is under control of respective cams (not shown) associated with each of the vend motors 22–32, and their operation will be described more in detail in connection with FIG. 2. The sold out switches 34–44 also have respective normally open contacts which are likewise connected to respective ones of the terminals CS1–CS6. It will only be necessary to described the operation of one of the vend motors and its associated cam and sold out switches since all are connected and operate in a similar manner. All of the connections indicated in FIG. 1 are shown brought out to the dotted outline and are connections that also exist in the circuit of in FIG. 2.

Each of the cam switches 46–56 such as the cam switch 46 is operated by an associated cam driven by the associated vend motor 22 and during a vend cycle when power is supplied to the vend motor 22, which occurs when the lead L1 is effectively connected to the lead $V_1$, the respective vend motor 22 will cause its cam to turn and during part of the operating cycle this will operate to transfer the associated cam switch 46 from the position shown to its transferred position. This occurs at an appropriate time in the cycle and causes the voltage on lead L1 to be applied to the corresponding lead CS1. This condition will be maintained long enough for a full cycle of motor operation to be completed, at which time, or sometime shortly therebefore, the cam associated with the operated vend motor will again cause its cam switch 46 to return to its normal open condition as shown in FIG. 1.

If, during the time that the cam switch 46 is in its transferred condition to maintain its vend motor energized the associated sold out switch 34 transfers from the condition shown in FIG. 1 to its transferred condition because the product being dispensed is the last product available to be vended under control of the energized vend motor 22, the power connection on lead L1 will be reestablished through a circuit that includes the normally open conditions of the two switches 34 and 46. This circuit provides a hold connection for the vend motor to enable the vend motor to be energized long enough to complete its operating cycle and to assure that the vend motor will restore its respective cam switch 46 to its normally open start position. These conditions establish that the energized vend motor 22 will not be available to be energized again should a customer select another of the same products under control of the same vend motor. The conditons just described can also be used to energize an indicator light (not shown) on the vending machine to indicate to a prospective customer that products vended under control of particular selection switches and vend motors are no longer available, and that the customer should select a different product that is available or not bother to make a deposit or selection. To more clearly understand the operations of the circuit of FIG. 1 it is necessary to understand the construction and operation of the more detailed circuit of FIG. 2.

The circuit of FIG. 2 includes means to apply and maintain the voltage at L1 on the circuit lead $V_1$ until the power connection between the lead $V_1$ and the lead CS1 has been removed by the return of the associated cam switch 46 to its normally open condition, as shown in FIG. 1. If, after a preset time period which is selected to exceed the longest expected vend time, this has not occurred, the controller circuit shown in FIG. 2 will remove the source connection on lead L1 from the connection to $V_1$.

Referring again to FIG. 1, the disclosure of the use of the 8-pin plug 10 is chosen to illustrate one relatively simple embodiment of the present invention. The embodiment selected to illustrate the invention is a standard single price construction wherein the power leads L1 and L2 are opposite sides of the power source, and the lead L3 is connected to the lead L1 for a short time, usually a fraction of a second, whenever any conventional coin changer is plugged into the receptacle 10. The electrical connection between the leads L1 and L3 occurs as a result of a customer depositing an amount of money, at least equal to the set vend price, into the changer. For a typical changer construction, the pin 5 of plug 10 will be operatively connected to the power lead L2 whenever the changer is low of change, a condition often indicated to the customer by the energizing of an exact change light. The lead L6 provides power for the lead L1 from the controller circuit of FIG. 2 to allow the changer to accept coins when it is not in a vend operation. This likewise is typical of known coin changer devices. The transformer 14, as stated, is included to provide a reduced operating voltage such as 12 volts for the power requirements for the controller circuit.

Referring to the control circuit of FIG. 2, the vend output connections $V_1$–$V_6$ are on the righthand side of the drawing, and power from the lead L1 is applied to these outputs through the normally open relay contacts $R_{C1}$–$R_{C6}$ of associated respective vend relays $R_1$–$R_6$. The vend relays $R$–$R_6$ are energized by completing a circuit from lead 58, labeled $V_{DD}$, through respective driver circuits in the integrated circuit chip 60.

The cam switches 46–56 of FIG. 1, which have connections to the respective leads CS1–CS6, are connected to respective isolation diodes 62–72. The cathodes of the diodes 62–72 are tied together as shown in FIG. 2 to provide half-wave alternating current to a light emitting diode (LED) 74 through a circuit which includes a limiting resistor 76, a capacitor 78 and a diode 80 connected as shown. The opposite sides of the light emitting diode 74, the capacitor 78 and the diode 80 are connected to the power lead L2. The light emitting diode 74 is part of an optical coupler 82 which includes a phototransistor portion 84 connected so that the operating potential $V_{DD}$ at terminal 86 will be applied through the phototransistor 84 whenever any one of the cam switches is transferred during a vend operation. This occurs whenever there is a potential present on any one of the connections CS1–CS6. Under these conditions, the potential $V_{DD}$ will also appear across a resistor 88 connected to the collector of the phototransistor 84. The base of phototransistor 84 is grounded through another resistor 90 which controls the gain or sensitivity of the phototransistor 84. The diode 80 which is connected in parallel with the light emitting diode 74 is provided to conduct and to bypass any reverse potential which might occur across the light emitting diode 74, and the capacitor 78 and the resistor 76 are included to limit the amplitude of the applied potential and to suppress transients.

The potential on the collector of the phototransistor 84 is the output thereof and is connected to the input of a filter circuit formed by capacitors 92 and 94 and resistor 96. The output of the filter circuit is therefore a DC potential that is important to the operation of the subject circuit and is applied to various points in the circuit as will be explained.

Referring again to FIG. 1, the sequence of a typical vending operation starts when the customer deposits money in the vending machine. When a deposit is sufficient to at least equal the vend price it will cause the power lead L3 to momentarily be connected to the source voltage L1, and this voltage will then be applied to diode 100 which is in parallel with the diodes 62–72. As in the case of the closing of any of the cam switches 46–56, this will cause a signal to be applied through the resistor 76 to and through the light emitting diode 74 of the optical coupler 82 to complete a circuit to the power lead L2. The completion of this circuit will cause the phototransistor 84 to conduct and will raise the potential on lead 102 in the output of the filter circuit to produce a high condition thereon represented by the potential $V_{DD}$. This in turn will provide a clock pulse (low to high) to be applied to clock input terminal 104 of credit flip-flop circuit 106. The D (data) input 108 of the flip-flop 106 is connected to the $\overline{Q}$ output 110 of vend flip-flop circuit 124. The $\overline{Q}$ output 110 is high during non-vend times, and the D-type credit flip-flop 106 will therefore transfer to a high ($V_{DD}$) on its Q 112 output. This will provide a high at the D input 114 of select flip-flop 116. The flip-flop 106 is described as being a credit flip-flop because it retains its Q output 112 in a high state after the occurrence of a signal on power lead L3, and it retains this same condition even after an unsuccessful vend attempt which occurs when a signal is applied to set input 118 of the credit flip-flop 106 as will be explained later.

The Q output 120 of the select flip-flop 116 will apply a high to the set input 122 of vend flip-flop 124 at the same time the flip-flop 116 receives a clock pulse (low to high) at the clock input 126. This clock pulse occurs when there is a signal on the output terminal 128 of OR gate 130 due to its input 132 being a high by the actuation of any one of the selection switches 1–6 which are in series with respective diodes 134–144 connected to respective outputs 146–156 of an octal counter 158. The details of the octal counter 158 will be described later. The signals on the output leads 146–156 of the octal counter 158 are signals that advance to a high state one at a time successively starting with the output lead 146 and advancing to the output lead 156. An advance takes place each time a clock pulse (low to high) is applied to the clock input 160 thereof. The clock pulses that are applied to the clock input 160 come from output 162 of a counter/divider and oscillator circuit 164.

When the vend flip-flop 124 was set by a signal present at its input 122, its Q output 166 went high and caused the input 168 of the OR gate 130 to also be high thereby maintaining the high at the output 128. This is true even if the input on the input lead 132 of the OR gate 130 is no longer maintained high by the holding down and closing of one of the selection switches 1–6. The high on the output of the OR gate 130 is applied to a clock inhibit input 170 of the octal counter 158, and operates to prevent any further changes from occurring on the counter outputs 146–156. Whichever of the select switches 1–6 was depressed operates to transfer its high-going pulse when and only when it corresponds to the respective output of the octal counter 158 in order, as just described, to stop any further progression of output pulses from the octal counter 158 so that the particular output that was selected remains at a high state. The condition thus established is applied to the corresponding input $D_1$–$D_6$ a buffer circuit 172 which operates to allow the high established thereon to cause a high to be also present at the corresponding output identified as the $Q_1$–$Q_6$ buffer outputs. The Q outputs of the buffer circuit 172 are not available until enable inputs or lows are present on the A and B enable inputs 174 and 176 thereof. The low applied to the enable inputs 174 and 176 is appled from the $\overline{Q}$ output 110 of the vend flip-flop circuit 124 after the vend flip-flop circuit 124 is set during vend time. The particular $Q_1$–$Q_6$ output of the buffer circuit 172 that is high is then applied to the corresponding input 178-188 of the output driver circuit 60 which has connections to the respective vend relays $R_1$–$R_6$ which when energized close their contacts $R_{C1}$–$R_{C6}$ energize the vend motor 22–32.

During vend time another input 190 to the output driver 60 goes low, removing the high that had been keeping the relay 192 energized. The relay 192 controls the connection between the power lead L1 and the lead L6 described in FIG. 1. When the relay 192 is deenergized the power lead L1 (lead 194 in FIG. 2) is disconnected from the power lead L6, lead 196, because of the normally open relay contact 198. The particular vend motor 22–32 that was energized will cause the dispensing of the particular selected product, and during the vending operation will cause its associated cam switch 46–56 to close to cause voltage to be applied from the power lead L1 to the optical coupler 82 through the associated diode 62–72 as explained above. The resultant high which thereupon appears on the lead 102 is then applied to the D input 200 of motor running flip-flop 202 through OR gate 204 which has its input 206 connected to the lead 102. During vend time the reset input 208 of the motor running flip-flop 202 is at a low condition because of its connection to the $\overline{Q}$ output 110 of the vend flip-flop 124. This allows the Q output 210 of the flip-flop 202 to go high as soon as the next clock pulse at the clock (C) input is received from the $Q_4$ output 162 of the counter/divider circuit 164. The resulting high on the D input 200 of the motor running flip-flop 202 causes a high on the input 212 to the OR gate 204 which is connected directly to the Q output 210. At the same time the $\overline{Q}$ output 216 of the flip-flop 202 goes low removing the high which held another flip-flop, identified as the vend terminate flip-fop 218, in reset condition. The connection for this is from the $\overline{Q}$ output 216 of the flip-flop 202 to the reset (R) input 220 of the flip-flop 218.

When the cam switch 46–56 associated with particular selected vend motor returns to its start or normally open position it removes the power connection from L1 to the input to the optical coupler 82 thereby causing the potential on the lead 102 in the output of the optical coupler 82 to return to its low condition. This in turn removes the high that was present at input 222 of NAND gate 224 causing the output 226 of the NAND gate 224 to go high. This high is applied to the D input 228 of the vend terminate flip-flop 218 and causes the $\overline{Q}$ output 230 of the flip-flop 218 to go low when the next clock pulse is received from the Q4 output of the counter/divider oscillator circuit 164 on the output 162. This is because the output 162 is also connected to the clock input 232 of the flip-flop 218. The low from the $\overline{Q}$ output 230 will keep the D input 228 of the flip-flop 218 high by the connection thereof to another input 234 of the NAND gate 224. This same low on the $\overline{Q}$ output 230 is also connected to reset the vend flip-flop 124 by connection to its reset input terminal 236 which is in a high state at this time because of the connection to the output of NAND gate 238, which has its input 240 connected to the $\overline{Q}$ output 230 of the flip-flop 218. When the vend flip-flop 124 resets it will operate to also reset the flip-flops 202 and 218 because of the connection from the $\overline{Q}$ output thereof at 110 on lead 242 which goes high. Subsequently the $\overline{Q}$ output 216 of the flip-flop 202, which is connected to reset input 220 of the flip-flop 218 operates to reset the flip-flop 218. Likewise, the inputs 174, 176, 190, and 108 will return to their former high states because of their connections to the $\overline{Q}$ output 110 of the vend flip-flop 124, thus terminating the vend operation, and disabling the power lead L6 and the credit lead L3.

When a vend motor has been energized it will commence to operate to cause a vend and eventually will close its associated cam switch 46–56 as aforesaid. When this occurs a high will appear on the lead 102 which will operate through the circuits described to cause the motor running flip-flop 202 to maintain the energized vend motor running to complete its cycle of operation. Once the respective cam switch that has been actuated returns to its normally open condition it will remove the high from the lead 102 and will thereafter reset the termination flip-flop 218 to terminate the energizing of the vend motor at the completion of its operating cycle. These operating conditions are made possible by operation of the two flip-flops 202 and 218 and their associated gate circuits 204 and 224. Of course, these circuits also depend for their operation on other portions of the circuit as well including primarily on the vend flip-flop 124, the credit flip-flop 106, and on a time out flip-flop 246 which is not reset until the time of occurrence of an output at the Q13 output 244 of the counter/divider oscillator 164, which output is applied to the clock (C) input 248 of the time out flip-flop 246. The Q13 output 244 goes high at some predetermined time selected to occur after the longest possible time required for any vend operation to take place. The D input 250 of the time out flip-flop 246 is connected to the Q output 166 of the vend flip-flop 124, which for an unsuccessful vend operation, remains in its high or vend state. This causes the Q output 254 of the time out flip-flop 246 to go high and operates to set the credit flip-flop 106 because of its connection to the set input 118 thereof.

A light emitting diode 256 is also energized at this time to indicate to the customer that he should make another selection, or, if the option is available obtain a refund of the amount deposited. The current flow for energizing the light emitting diode 256 is limited by resistor 258 which is grounded though a circuit that includes driver 260 having an output 262 connected as shown to the resistor 258 and an input 264 connected to the Q output 254 of the time out flip-flop 246. If another alternate selection is made by the customer, the credit flip-flop 106 will again enable the D input 114 of the select flip-flop 116 to initiate a sequence of operations that is necessary to produce a vend of the different selection. The time out flip-flop 246 will be reset on receipt of the next occurring pulse from the Q10 output 266 of the counter/divider oscillator 164.

The timing of the outputs Q4 at 162, Q10 at 266, and Q13 at 244 of the counter/divider oscillator circuit 164 are determined by the values selected for capacitor 268 and resistors 270 and 271 connected thereto as shown. Typically, 20 milliseconds is a good selection for the timing of the pulses on the Q4 output 162, 1.28 seconds for the timing of the Q10 outputs 266, and 10.24 seconds for the timing of the Q13 outputs 244. These times can be varied as desired to accommodate the differing requirements of the present circuitry and of the circuitry and operating conditions of the vending machine, and the counter/divider oscillator 164 can also have other timed pulse outputs such as a Q12 output 272, a Q9 output 274, and a Q8 output 276 as well as others as desired and needed.

The circuit also includes an initial reset flip-flop 278 which is held in reset condition by a signal present on its reset input 280 from the output of power supply 282. The power supply 282 is so constructed that when it is turned on it will not permit its output 284 to go low until the voltage on its $V_{DD}$ output 286 reaches approximately 80% of its desired operating potential. Typically the power supply 282 includes one or more transistors and associated resistors, and various known power supplies can be used for this purpose. When the output on the terminal 284 goes low, the initial reset flip-flop 278 will wait until its clock input 288 is pulsed by a clock pulse appearing on the Q10 output 266 of the counter/divider oscillator 164. When this signal occurs it will remove the high from the $\overline{Q}$ output terminal 290 of the initial reset flip-flop 278 and this will remove the high from the reset input 292 of the octal counter 158 and will also remove the low from the Q output 294. This will also remove the high from the reset input 236 of the vend flip-flop 124.

The embodiment shown and described in FIG. 2 is for a standard single price coin changer wherein credit is established by a signal present at L3 on lead 298. However, it is not intended to limit the present invention to use with a single price coin changer since it can also be used with other types of changers including more sophisticated and more versatile changers including changes which have means to clock in vend pulses such as at the clock input 300 of the vend flip-flop 124. This input in the construction shown in FIG. 2 is connected to ground but in other constructions will not be grounded. Furthermore, whereas the embodiment as shown uses standard C-MOS logic chips, it is contemplated that other solid state technology could be used including the use of one or more programmable microprosessor chips with appropriate interfacing components that would produce similar results and with a similar sequence of events as hereinabove described.

It should be apparent that the present vending control system provides reliable, failsafe operation and assures that each time a vend motor is energized it will run for a full operating cycle during which it will cause a vend and will cause its associate cam switch to transfer in order to assure that each operating cycle is completed. This is true even though during a cycle of operation the product availability switch transfers to indicate that there are no more products available to be vended under control of a particuar vend motor. The present circuit includes the means to assure that this will be done and that the customer will not lose his credit and will be able to make an alternate selection if he should inadvertently select a product that has been exhausted or otherwise fails to deliver for some reason.

Thus there has been shown and described a novel vendor control system which fulfills all the objects and advantages sought therefor. It will be apparent to those skilled in the art, however, that many changes, modifications, alterations, variations, and other uses and applications for the subject device are possible and contemplated, and all such other changes, modifications, alterations, variations, and other uses and applications which do not depart from the spirit and scope of the invention are deemed to be covered by the invention which is limited only by the claims which follow.

What is claimed is:

1. In a vend control system having means to accept and accumulate amounts of credit entered by a customer, a plurality of vend delivery means each having a product associated therewith and being selectively energizable to vend such product, and selection means actuatable by the customer to select a particular product from among the products that are available to be vended, the improvement comprising common circuit means associated with all of the vend delivery means and the selection means, a plurality of means each associated with a respective vend delivery means and operable when the supply of products to be vended under control of the respective vend delivery means becomes exhausted during a particular vend cycle to prevent the energizing during future vend cycles of said respective vend delivery means but not of others of said vend delivery means, and other means to maintain the selected vend delivery means energized for a full cycle of operation even if during a particular vend cycle the one of said plurality of means associated with the respective selected vend delivery means operable to prevent the further energizing of the selected vend delivery means operates thereby indicating that the supply of the product associated with such selected vend delivery means has become exhausted, said other means including a plurality of switch means each associated with a respective vend delivery means and operating under control thereof to cycle between two conditions during a complete operating cycle of the energized vend delivery means, means in said common circuit means operatively connected to all of said switch means and responsive to the operation of any of said switch means to effect maintenance of energization of the energized vend delivery means for a full cycle of its operation.

2. A control circuit for a vending machine having means accept credit entries, a supply of products to be vended, customer actuatable selection means for selecting a particular product from among the aupply of products for vending, motor means under control of the respective selection means energizable to vend products selected by the customer when the credit entered in the means to accept credit at least equals the vend price of the selected product, and means to prevent energizing of selected vend motor means when the supply of the respective product associated therewith is exhausted, the control circuit comprising means for producing a control signal when the credit entered in the means to accept credit at least equals the price of a selected vend, means responsive to the occurrence of the control signal to enable a customer to be able to effectively make a selection of a product to be vended including enabling energizing of a respective vend motor means to produce a vend cycle, switch means associated respectively with each of the vend motor means movable during a vend cycle from an inoperative to an operative condition under control of the respective energized vend motor means, means under control of the respective switch means in the operative condition thereof and including the respective means to prevent energizing of the energized vend motor means when the energized vend motor means is vending the last product available to be vended to establish a circuit condition to maintain the respective vend motor means in an energized condition for a long enough time period to assure a full operating vend cycle thereof, a circuit portion common to all the vend motor means including a bistable motor run circuit, a bistable vend terminate circuit under control of the bistable motor run circuit, and a timing out circuit under control of the means to accept credit entries, operation of the vend terminate and timing out circuits operating to maintain a selected one of the vend motor means energized for a time period at least equal to some predetermined time period established by the timing out circuit that is selected to be at least as long as the longest anticipated time for a vend operation to take place, and means to reset the control circuit at the conclusion of each vend cycle.

3. The control circuit of claim 2 including circuit means under control of the timing out circuit for establishing circuit conditions whereby a customer may make another selection if the time period established by the vend terminate and timing out circuit expires before a vend operation is completed.

4. The control circuit of claim 3 including means connected between the timing out circuit and the means to accept credit entries for reestablishing a credit condition if the timing out period expires before a vend operation is completed.

5. The control circuit of claim 4 including means connected between the means to accept credit entries and the customer actuatable selection means to enable an alternate selection to be made if the timing out period expires before a vend operation is completed.

6. A vend control circuit for a vending machine having means to accept deposites, means to establish vend price, means to select from among a plurality of products to be vended and means energizeable to cause a vend of a selected product, the improvement comprising means to establish a power connection when an amount deposited at least equals the established vend price of a product to be selected, means including an optical coupler responsive to the power connection to establish a credit condition to enable selection of a product for vending regardless of which of the Products is selected, means including a cycling counter having sequentially occurring outputs corresponding respectively to the different possible products that can be selected to be vended to establish a vend signal, means to stop the cycling of the cycling counter when the output therefrom corresponds to a product that is selected, means responsive to the vend signal to enable energizing of selected vend causing means by the means to select, switch means under control of the respective energized vend causing means to cause a vend operation to be initiated, common circuit means responsive to energization of any one of the selectable vend causing means to establish a circuit condition to assure that the energized vend causing means will remain energized for sufficient time to complete a vend cycle of operation, including means to control the deenergizing of the vend causing means and the termination of a vend cycle, and means to reset the control circuit when a vend cycle is terminated.

7. The vend control circuit of claim 6 including means in the common circuit means to establish a time period of predetermined duration at least equal to some arbitrary time duration longer than the longest expected time required for a vend cycle to take place including means to produce an output whenever said time period expires before a vend operation is terminated, and means responsive to said output to reestablish the credit condition to enable the customer to make another selection and to reset the common circuit means.

8. The vend control circuit of claim 6 wherein the means responsive to selection of a product to be vended includes a plurality of selection switches and the cycling counter operatively connected thereto, means for predeterminately advancing the count in the cycling counter until a predetermined relationship is established between an actuated selection switch and the count in the cycling counter, said predetermined relationship producing a response useful to energize a corresponding one of the vend causing means to produce the desired vend operation.

9. The vend control circuit of claim 6 wherein the means energizeable to cause a vend of a selected product include a plurality of vend motors movable from a predetermined initial deenergized condition between vend operations and an energized condition when causing a vend cycle of operation to cause a product to be vended, and switch means under control of each respective vend motor, each of said switch means having an inoperative condition which exists when the respective vend motor is in its predetermined initial deenergized condition and a transferred condition when the respective vend motor is in a predetermined portion of its energized cycle of operation.

10. the vend control circuit of claim 6 wherein the means responsive to the power connection includes an optical coupler having a photodiode portion energizeable when the power connection is established and a phototransistor portion under control of the photodiode portion.

11. The vend control circuit of claim 10 wherein the photodiode portion is energized in response to the switch means associated with any one of the vend causing means being in its transferred condition.

12. The vend control circuit of claim 7 including a pulse generator having a plurality of outputs at which timed output signals are produced including a first output at which signals occur at a first frequency, and a second output at which signals occur at a less frequent rate, said second output being operatively connected to the means to establish a time period.

13. The vend control circuit of claim 8 including a pulse generator having a plurality of ouputs at which output signals are produced, including a first output at which signals occur at a first frequency and a second output at which signals are produced at a less frequent rate, said first output being connected to the cycling counter.

14. In a control circuit for a vending machine capable of vending a plurality of different products at a preestablished vend price and including means to produce a response when an amount of credit is entered that at least equals the vend price, means responsive to said response to establish a credit condition, means responsive to the establishment of a credit condition to enable selecting a product to be vended, a plurality of vend motor means and circuit means associated therewith including circuitry for selectively energizing each of said vend motor means to vend a selected product when a credit condition is established, switch means associated with each respective vend motor means transferrable to an actuated condition during a portion of the time period when the associated vend motor means are energized, a common circuit for operation with all of the vend motor means including a bistable motor run circuit and bistable means under control thereof to maintain an energized vend motor means energized for a complete vend cycle of operation, means responsive to the closing of any one of the switch means associated with respective motor means to energize the bistable motor run circuit, a normally closed product available switch connected in the circuit means associated with each respective vend motor means, each of said product available switches transferring from its normally closed condition to its transferred condition when the supply of the products associated therewith becomes depleted, and means including the transferred condition of the respective product available switch means associated with each of the respective energized vend motor means and the switch means associated with each respective vend motor means to establish circuit conditions to maintain a selectively energized one of the vend motor means in an energized condition for a full cycle of operation when the respective product available switch transfers from its normally closed to its transferred condition during a vend operation.

* * * * *

UNITED STATES PATENT OFFICE

CERTIFICATE OF CORRECTION

Patent No. 4,478,353 Dated October 23, 1984

Inventor(s) Joseph L. Levasseur

It is certified that error appears in the above-identified patent and that said Letters Patent are hereby corrected as shown below:

Column 2, line 36, the sentence beginning with the word "Referring" should begin a new paragraph.

Column 2, line 67, "46 14 56" should be --46-56--.

Column 3, line 1, "CS1 14 CS6" should be --CS1-CS6--.

Column 6, line 13, before "energize" insert --to--.

Column 9, line 26, "further" should be --future--.

Column 9, line 40, after "means" insert --to--.

Column 9, line 42, "aupply" should be --supply--.

Column 10, line 38, "deposites" should be --deposits--.

Column 10, line 49, "Products" should be --products--.

Column 11, line 39, "the" should be --The--.

UNITED STATES PATENT OFFICE
CERTIFICATE OF CORRECTION

Patent No. 4,478,353 Dated October 23, 1984

Inventor(s) Joseph L. Levasseur

It is certified that error appears in the above-identified patent and that said Letters Patent are hereby corrected as shown below:

Column 12, line 34, before "respective" insert --the--.

Signed and Sealed this

*Eighteenth* Day of *June 1985*

[SEAL]

*Attest:*

DONALD J. QUIGG

*Attesting Officer* *Acting Commissioner of Patents and Trademarks*